United States Patent [19]

Morande, Jr.

[11] 4,213,443

[45] Jul. 22, 1980

[54] STOVE CONSTRUCTION

[75] Inventor: James A. Morande, Jr., Glastonbury, Conn.

[73] Assignee: All Nighter Stove Works, Inc., Glastonbury, Conn.

[21] Appl. No.: 886,283

[22] Filed: Mar. 13, 1978

Related U.S. Application Data

[63] Continuation-in-part of Ser. No. 798,263, May 18, 1977, abandoned.

[51] Int. Cl.[2] ..... F24C 1/14; F24C 15/08; F24C 13/00

[52] U.S. Cl. ..... 126/72; 126/5; 126/278; 126/61; 126/193

[58] Field of Search ..... 126/19, 193, 5, 72, 126/121, 202, 160, 113, 134, 142, 278, 279, 122, 61, 63, 31

[56] References Cited

U.S. PATENT DOCUMENTS

| | | | |
|---|---|---|---|
| 4,785 | 10/1846 | Conde | 126/6 |
| 119,949 | 10/1871 | Perry et al. | 126/193 |
| 167,852 | 9/1875 | Moore | 126/5 |
| 286,411 | 10/1883 | Foote | 126/160 |
| 353,422 | 11/1886 | Morgan | 126/5 |
| 393,269 | 11/1888 | Sanders | 126/98 |
| 434,023 | 8/1890 | Middleby | 126/19 |
| 543,360 | 7/1895 | Towne | 126/72 |
| 574,315 | 12/1896 | Fales | 126/160 |
| 991,198 | 5/1911 | Clawson | 126/6 |
| 1,350,495 | 8/1920 | Hagenbuch | 126/121 |
| 1,551,067 | 8/1925 | Sperry | 126/278 |
| 1,672,792 | 6/1928 | Thomes | 126/160 |
| 2,183,458 | 12/1939 | Lathrop | 126/134 |
| 2,453,954 | 11/1948 | Wright | 126/122 |
| 3,765,399 | 10/1973 | Gerlach | 126/134 |
| 3,901,212 | 8/1975 | Stites | 126/121 |
| 4,027,649 | 6/1977 | Jackson | 126/202 |

FOREIGN PATENT DOCUMENTS

| | | | |
|---|---|---|---|
| 13521 | of 1913 | United Kingdom | 126/142 |
| 21578 | of 1914 | United Kingdom | 126/121 |
| 503188 | 4/1939 | United Kingdom | 126/142 |
| 732497 | 6/1955 | United Kingdom | 126/121 |

*Primary Examiner*—Martin P. Schwadron
*Assistant Examiner*—A. Michael Chambers
*Attorney, Agent, or Firm*—McCormick, Paulding & Huber

[57] ABSTRACT

A rectangular stove structure has a stepped top with a sloped intermediate top portion having heated air outlets. Room air is passed through U-shaped ducts arranged along the inside surfaces of the stove side walls, and firebrick is provided on the floor of the stove structure between these ducts. Air is drawn into the ducts through a side opening which may have a blower and conduit associated therewith. The door of the stove has rotary combustion air inlets, and a baffle plate is provided inside the door to provide primary air for the fire, and secondary air for improving air circulation and ventilation inside the stove. Domestic hot water can be heated at the rear of the stove structure in an annular chamber defined for this purpose at the connection for the exhaust gas flue. Domestic hot air can be supplemented by a plenum provided on the lower front top, and the plenum receives heated air from the outlets in the sloped intermediate top portion. Coal can be burned in a novel grate provided in the stove, and a humidifier is hung on a flange at the rear of the stepped top. All of these improvements can be used simultaneously. A heat radiator plate is mounted to the stove legs.

29 Claims, 13 Drawing Figures

STOVE CONSTRUCTION

CROSS REFERENCE TO RELATED APPLICATION

This application is a continuation-in-part of Ser. No. 798,263, filed May 18, 1977, now abandoned under the same title by the same applicant and assigned to the assignee herein.

BACKGROUND OF INVENTION

Convective heating in residential radiant type wood burning stoves is well known. U.S. Pat. Nos. 543,360; 545, 772; 220,637 and 3,358,671 show this feature in stove constructions generally. The stepped top for achieving two levels of temperature in a stove construction is also well known. U.S. Pat. Nos. 4,785; 393,269; 637,965 and 1,999,515 show this feature in other prior art stove constructions. Also well known in the prior art is the use of a baffle plate or similar device on the inside of the stove access door to reduce the temperature of the door itself, and thereby provide a safer stove which is less likely to suffer structural damages to the hinged door, and to the adjustable air inlet valves normally provided in the door itself.

The chief aim of the present invention is to combine all of these features in a single stove construction, and to provide other advantages as well. Not only does the stove construction disclosed have the convective heating, the two temperature top, and the internal air baffled door construction, but the disclosed stove construction also has facilities for heating water at the rear of the stove, and a novel grate for burning coal, as well as other features to be described in greater detail hereinbelow.

SUMMARY OF THE INVENTION

This invention relates generally to residential heating and cooking stoves, and deals more particularly with an improved free standing stove construction of generally rectangular configuration, having a two level top with an intermediate panel in which convection air outlets are provided. The air to be heated is drawn into a side opening in the stove, which may have a blower associated therewith. This room air passes through two U-shaped internal ducts or conduits located along the corners defined by the rectangular stove's floor and rear and side walls. The flue duct opening has an annular shroud which cooperates with the flue duct itself to define an annular heat exchange cavity located at least partly inside the stove structure. This cavity is adapted to receive a heat exchanger for heating domestic hot water or the like. The access door in the front of the stove has an air inlet valve opening or openings, and a backing plate or baffle for distributing the air to the fire itself so that some secondary air flows through the stove above the fire for improved combustion and ventilation of the stove interior. A removable grate permits coal to be burned, and a heat radiator plate between the stove and the surface upon which the stove is supported provides efficient and safe stove operation.

DETAILED DESCRIPTION OF FIGS. 1–8

Figure 1:
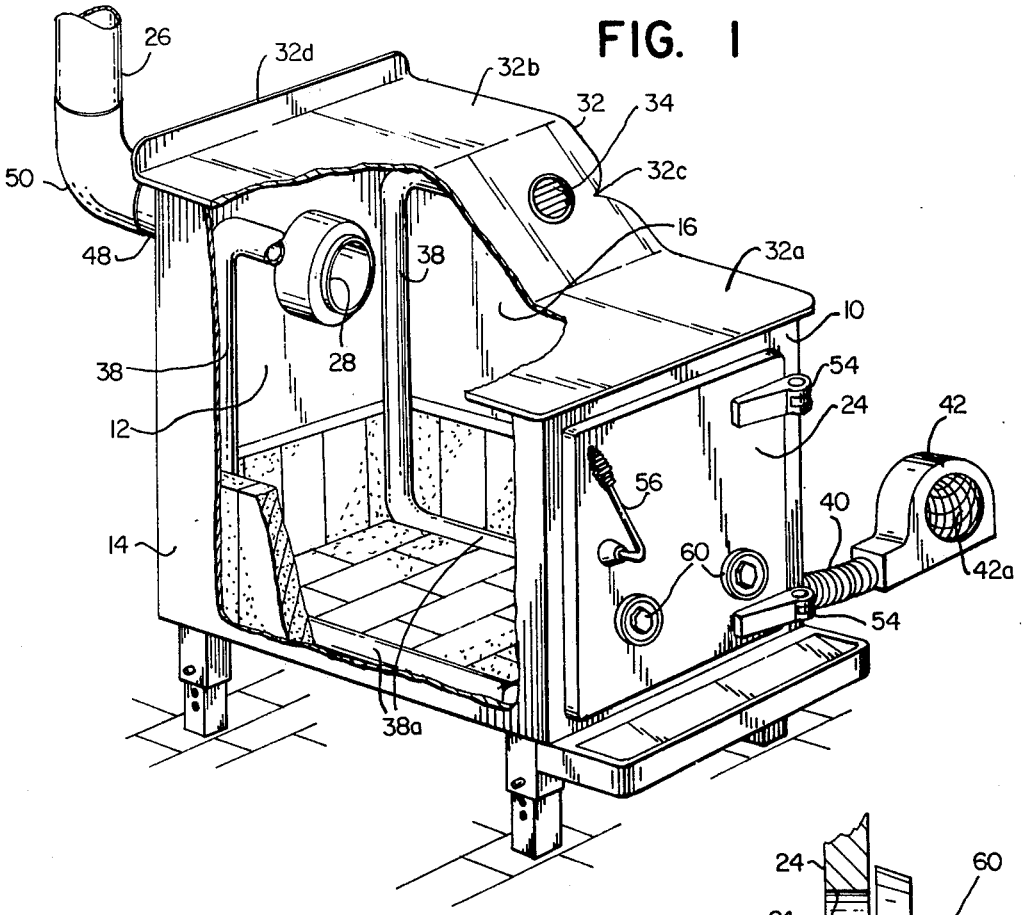
FIG. 1 is a perspective, front/top quartering view, of a stove constructed in accordance with the present invention, and with portions broken away to reveal the convection conduits and other features of the stove.

Turning now to the drawings in greater detail, FIG. 1 shows a free standing generally rectangular stove structure, including front and rear walls, 10 and 12 respectively, connected to one another by side walls, 14 and 16, and by a generally horizontally extending floor 18 which may be provided with a liner 20 of conventional firebrick or the like. The floor of the rectangular stove structure is supported on adjustable legs as indicated generally at 22, 22 such that the stove can be levelled on floors which are not entirely flat or horizontal.

The front wall 10 defines an access opening 10*a* which is adapted to be closed by a door 24, to be described in greater detail hereinbelow. The rear wall 12 has a flue opening which is adapted to receive a flue 26 by means of a flue duct 28, which flue duct projects inside the stove and is mounted in an annular or cup shaped shroud 30 to be described hereinbelow. A flue duct extension 48 and elbow 50 may also be provided as shown.

The top of the stove structure departs from the generally rectangular shape of the above-described portions, and includes a stepped, one piece member 32 having a lower level or portion 32*a* and an upper level or portion 32*b* intergrally connected to one another by means of an intermediate portion 32*c* which intermediate portion is inclined upwardly and rearwardly, and defines openings, as indicated generally at 34 in FIG. 1. The side edges of this intermediate portion 32*c* may be indented as illustrated in FIG. 1.

Figure 2:
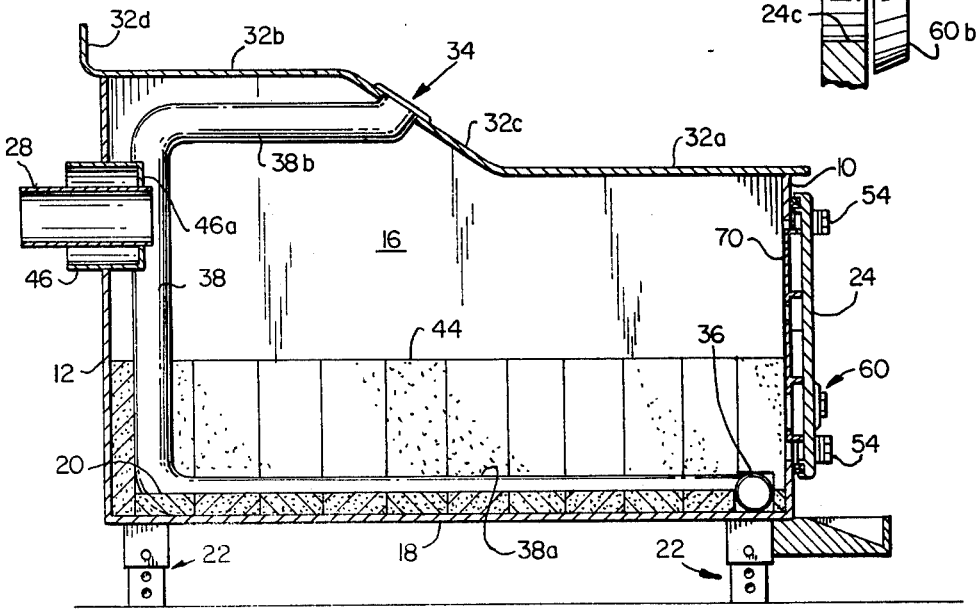
FIG. 2 is a vertical longitudinal sectional view through the stove of FIG. 1.

Still with reference to FIG. 1 at least one and preferably two U-shaped conducts or ducts are provided inside the stove structure and each includes a lower forwardly extending leg portion 38*a*, 38*a* open at its forward end and connected to a crossover pipe 36 best shown in FIG. 2, which pipe 36 connects to a conduit 40 which may have a blower housing 42 associated therewith.

Room air is drawn through the blower housing inlet 42*a* through the conduit 40 and thence into the cross-over pipe 36 and the forward ends of the lower leg portions 38*a*, 38*a* of these U-shaped conduits, which conduits 38, 38 are layed between the firebrick as best shown in FIGS. 1 and 2 so that this air is heated by the relatively hot firebrick in the stove, and thence passes upwardly through the vertically extending segments 38, 38 and turned forwardly for movement in the forward direction through the segments 38*b*, 38*b* to be returned to the room through the openings 34, 34 associated with the top portion of the stove structure. The location for these U-shaped internal conduits or ducts at the junctions between the rear and side walls, and between the side walls and the floor of the stove structure, provides an improved stove construction. Convection air is drawn in through the blower 42 and conveniently heated in the stove and returned to the room in a manner which not only provides for efficient heating of this air, but which also provides for cooling of the stove structure itself in the areas where structural integrity can be important, namely in the areas where the side walls and front and rear walls are welded to the floor. These ducts 38, 38 are also out of the way of the fire building space itself providing an operationally efficient stove structure.

A first course of vertically oriented firebrick 44 may be provided along the side walls 14 and 16 of the stove, and also along the rear wall 12, in order to improve the radiant heat characteristics of the stove structure itself, which characteristics are improved by the massiveness of the stove structure generally, and it will be apparent that an additional course of such firebrick along the sides of the stove might also be provided within the scope of the present invention (either being layed on edge or placed upright above the single upright course shown).

Considering FIG. 2 in greater detail, the rear of the stove top is seen to include an upstanding flange 32*d* integrally formed with the upper level 32*b* of the stove top. The rear wall 12 of the stove structure defines an opening for receiving a generally annularly shaped shroud 46, which shroud is generally cup-shaped, having a portion which projects inside the stove, and which defines a radially inwardly turned flange 46*a*. This flange 46*a* in turn defines a circular opening for receiving the flue duct 28. The flue duct 28 is adapted to be connected to the elbow 50 as best shown in FIG. 1 by an extension 48 if necessary to provide a path for the exhaust gases as they pass upwardly into the flue 26 or any similar existing chimney, or other conventional stack means for carrying away the products of combustion.

Figure 8:
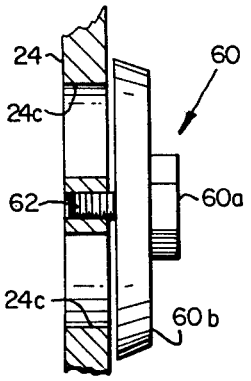
FIG. 8 is a vertical sectional view through one of the two air inlet valves in the stove door.
Figure 6:
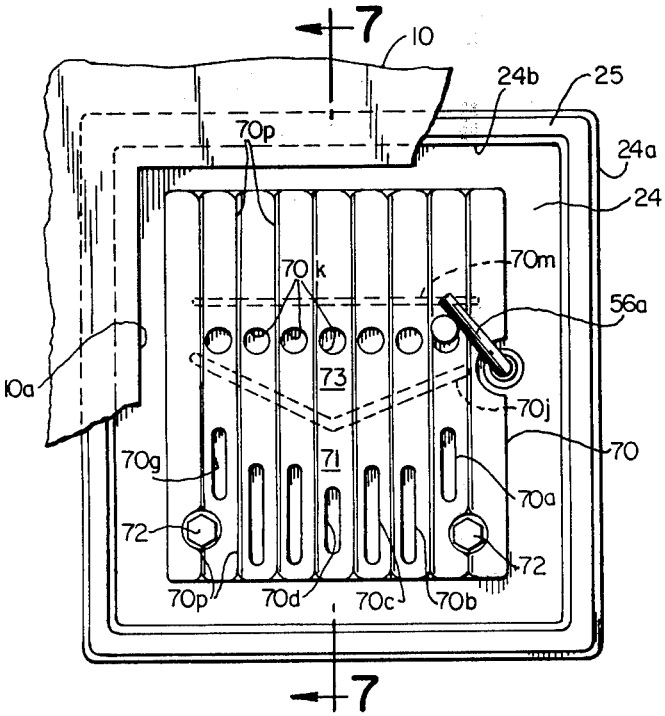
FIG. 6 is a rear view of a portion of the door opening, the access door, and the baffle plate showing details of the door seal.
Figure 7:
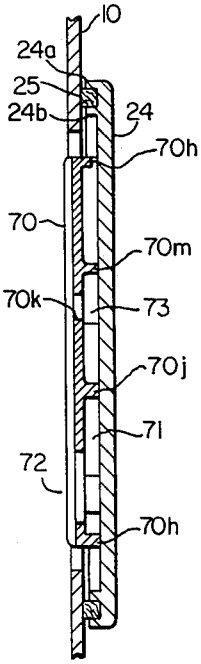
FIG. 7 is a vertical sectional view taken on the line 7—7 of FIG. 6.

Turning next to a more complete description of the front wall of the stove, the door 24 is illustrated in cross section in FIG. 2, and will be seen to have a baffle plate 50 attached to the interior of the door 24 as shown in greater detail in FIGS. 6 and 7. The door 24 comprises a casting having rearwardly projecting peripheral flanges 24*a* and 24*b* defining a rearwardly open rectangular recess for receiving an asbestos seal 25. The seal 25 engages the front surface 10 of the stove when the hinged door 24 is closed as shown. The hinges are shown in FIGS. 1 and 2 at 54, 54 and a conventional handle 56 has an inside latch part 56*a* for engaging the inside of the front wall 10 of the stove to hold the hinged door in the closed position. Two air inlet valves 60, 60 are provided in the door 24, and FIG. 8 illustrates one of these valves 60 in detail. Each valve 60 has a threaded post 62 received in a threaded opening defined by the door 24, and semi-circular opening segments 24*c*, 24*c* are provided around this central opening to admit air to the stove. The valve 60 has a hexagonal hand operated head portion 60*a*, and an annular portion 60*b* for metering the inlet air by rotation of the valve 60.

Still with reference to the front of the stove a shelf 52 is provided along the lower edge of the front wall and includes a recessed portion 52*a* which is adapted to receive any ashes or cinders or the like inadvertently dropping from the floor of the stove structure upon opening of the door 24.

Air for combustion inside the stove is not only metered by the inlet valves 60, 60 but is also further controlled by a baffle plate 70 bolted to the inside of the door 24*b* by screws 72, 72. This plate 70 has a lower region defining a series of primary air outlets, 70*a*–70*g* inclusively, arranged laterally across the width of the plate to provide air to the fire from a primary air chamber (best shown in FIG. 7 at 71) between the door 24 and the plate 70. The baffle plate 70 has a peripheral extending forwardly projecting flange 70*h* which abuts the door to space the plate therefrom, and a chevron shaped flange 70*j* extends laterally across the plate just above the primary air outlets 70*a*–70*g* to provide the desired inlet air pressure in the chamber 71, but which chevron shaped flange 71*j* will allow some primary air to pass between the peripheral flange 70*h* and the ends of the chevron flange 70*j* into the secondary air chamber 73 from whence secondary air can be provided to ventilate the upper portion of the inside of the stove, and improve the burning efficiency of the stove. Secondary air outlets 70*k*, 70*k* are provided in the baffle plate 70 for this purpose, and another laterally extending flange 70*m* is defined in the plate to improve the secondary air pressure and flow characteristics of this secondary air chamber 73. Finally, it should be noted that the inside surface of the baffle plate 70 not only defines the flanges 70*h*, 70*j*, and 70*m*, but that said inside surface also defines fluted vertically extending portions with these outlets 70*a*–70*g* and 70*k* defined in the relieved spaces between the flute defining ribs 70*p*, 70*p*.

Figure 3:
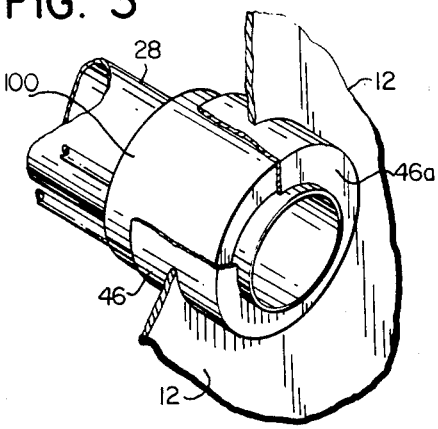
FIG. 3 is a detailed view of one type of fluid heat exchange device adapted for use with the FIG. 1 stove.
Figure 4:
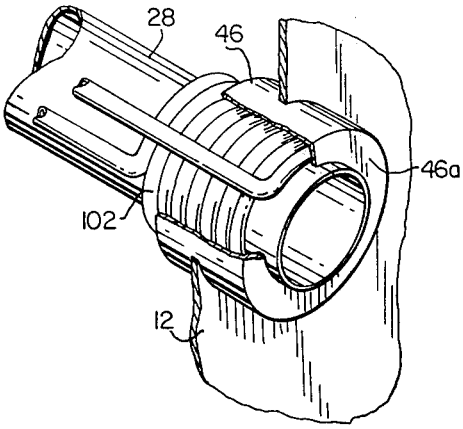
FIG. 4 is a detailed view of still another type of fluid heat exchange device adapted for use with the FIG. 1 stove.

Turning next to the annular fluid heat exchange cavity defined between the flue pipe 28 and the shroud 46, FIGS. 3 and 4 show two possible configurations for the fluid containing compartment therefor. In FIG. 3 an annular tank 100 is provided in this annular cavity, and fluid inlet and outlet lines communicate with the tank so that domestic water can be circulated through the heat exchange cavity. In FIG. 4 a coil 102 is provided in the same annular cavity for the same purpose, namely to provide a source of heat for domestic hot water fed to and from the coil by the fluid inlet and outlet lines shown.

Figure 5:
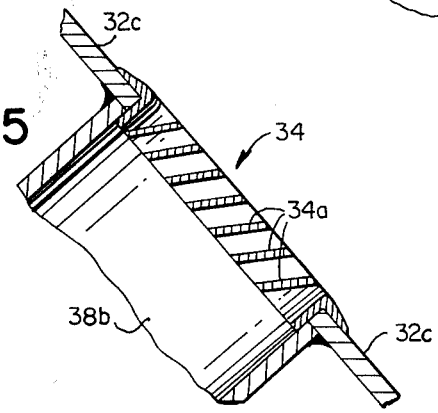
FIG. 5 is a detailed view of a vent grille insert adapted for use in one of the heated air outlets for the FIG. 1 stove.

Finally, FIG. 5 shows, in cross section, the air vent grilles 34, 34 provided in the inclined intermediate top portion 32*c*. The ends of the U-shaped conduits 38*b* are turned slightly (as best shown in FIG. 2) so that the open end of each of these conduits or ducts is oriented normally to the surface 32*c*. As a result of this normal, or right angled, configuration for the conduit 38*b* and the surface 32*c* the grille 34 can be rotated in its FIG. 5 position to change the orientation of the vanes 34*a* defined in the grille 34 and thereby alter the direction of the heated air flowing from the conduit 38 to project this air to the desired part of the room where the stove is located.

DETAILED DESCRIPTION OF FIGS. 9-11

Figure 9:
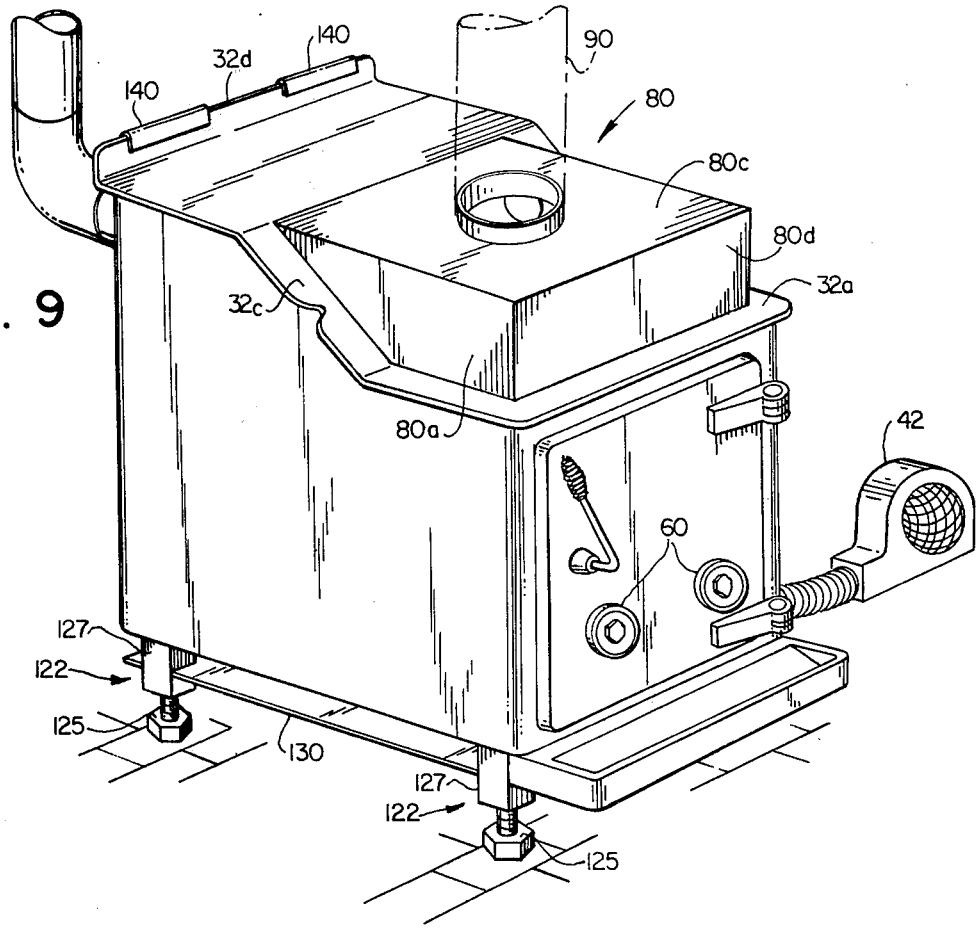
FIG. 9 is a perspective view of a stove similar to that shown in FIG. 1, but with a heated air plenum mounted on the lower level of the stove top and improved leg construction.
Figure 10:
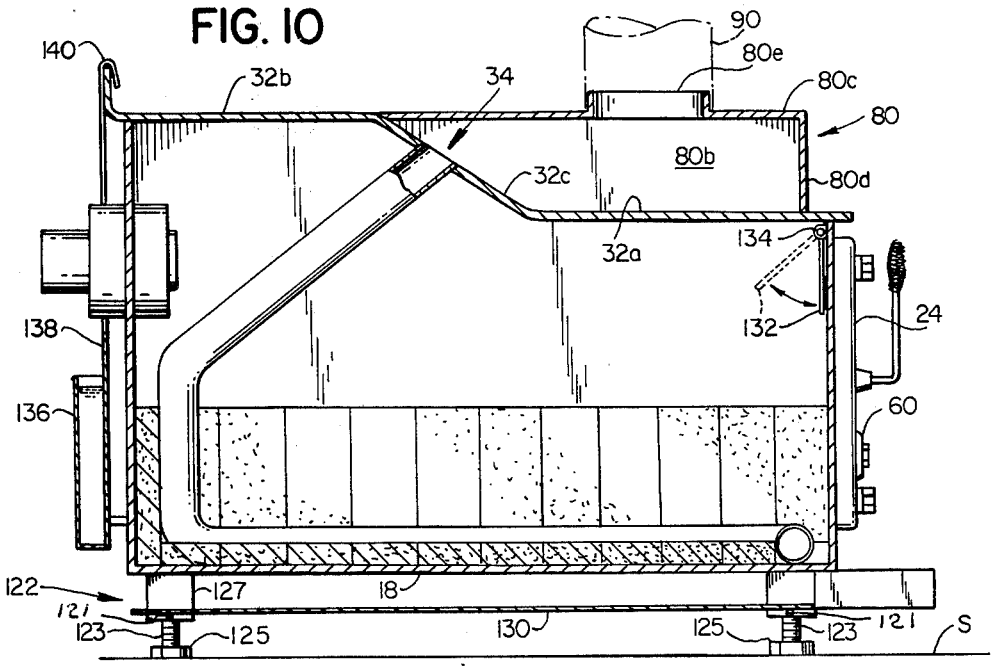
FIG. 10 is a vertical longitudinal sectional view through the stove of FIG. 9.
Figure 11:
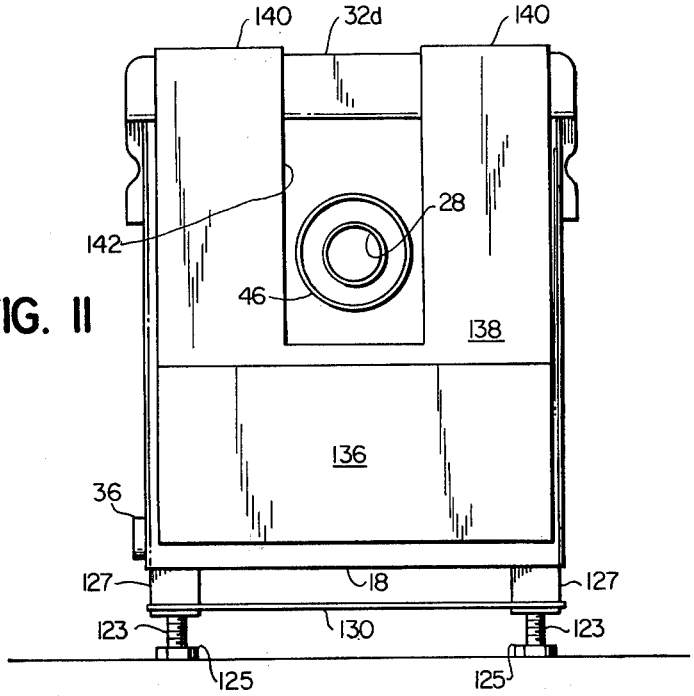
FIG. 11 is a rear view of the stove of FIGS. 9 and 10.

The stove of FIGS. 9-11 is generally similar to that of FIGS. 1-8, and identical parts are given identical reference numbers to facilitate an understanding of this version. The firebox defining structure is the same, and the front, rear, and side walls are preferably formed from one piece of steel which is butt welded at the top bottom of the front door access opening. The internal U-shaped conduits are slightly different in shape to eliminate one 90 degree bend, and to improve the flow of air being heated in these conduits.

The stove legs 122, 122 which support the FIG. 9 stove are slightly different than those shown in FIG. 1 at 22, 22 and are infinitely adjustable in length to permit adjustment of the stove position even on very uneven floors. The lower threaded post portion 123, 123 has a large hexagonal head 125 which can be rotated to adjust the post portion 123 axially in the depending female threaded boss 127.

A metal heat radiating plate 130 is notched to receive these rectangular leg bosses 127, 127, and the plate is pinned as shown at 121, 121 in FIG. 10 to slidably support it on these bosses between the stove floor 18 and the surface S upon which the stove rests. The heat radiating plate 130 serves a twofold purpose. First, it provides for less heat radiated from the stove itself to the surface S, providing a safer stove installation. Second, it absorbs this radiated stove heat and radiates or conducts such heat to the air in the room where the stove is installed, thereby improving the heating efficiency of the stove.

Another feature of the stove shown in FIGS. 9 and 10, is the provision of a smoke baffle plate 132 pivotally mounted inside the access door opening at 134. This hinged plate 132 is gravity biased toward the solid line position shown in FIG. 10, but can be moved upwardly through the position shown in broken lines to facilitate loading of wood or coal into the stove. The hinged plate will, therefor, normally be in the active or solid line position shown such that the hinged access door 24 can be swung open without causing smoke to inadvertently escape into the room.

Still another feature of the FIG. 10 stove is the addition of a humidifier at the rear of the stove. The humidifier comprises a generally rectangular reservoir capable of storing a quantity of water as shown. The inside wall 138 of the rectangular reservoir extends upwardly as shown, and the upper end defines a downwardly turned flange as shown at 140 so that the humidifier structure can be conveniently supported from the rear flange **32*d* of the stove top. The supporting wall 138 is notched as best shown at 142 in FIG. 11 to accommodate the flue duct 28 and shroud 46 as best shown in FIG. 11**.

As mentioned previously, the stove of FIGS. 9-11 is generally similar to that of FIGS. 1-8, and heat from the fire inside the stove will heat room air by radiation and convection, and also by passing air through the U-shaped conduits and out through the opening 34, 34 in the sloped intermediate top **32*c***. Means is provided for receiving the air so heated by these conduits, and said means will now be described in detail.

FIGS. 9 and 10 illustrate a four sided plenum 80, which has side walls **80*a*, 80*b* spaced apart laterally to receive the openings 34, 34 therebetween. The inside edges of these side walls fit snugly against the inclined intermediate portion 32*c*, and the top wall 80*c* is horizontal and at the same height as the upper portion 32*b* of the stove top. A front wall 80*d* of the plenum 80 completes the four sided structure and FIG. 9 shows the vertical sides 80*a*, 80*b* and 80*d* are preferably spaced inwardly of the top 32 and the side and front walls of the stove structure to provide an unobtrusive plenum design which permits easy connection to a hot air duct 90** for integrating the stove heat with a hot air home heating system.

The top wall **80*c* of the plenum structure 80 preferably defines an annular flange 80*e* for receiving the hot air duct 90 as best shown in FIG. 10. This vertical sectional view shows how the room air moves through crossover pipe 36, upwardly through the two U-shaped conduits 38, 38 and thence into the plenum 80 through openings 34, 34. Additional heat is provided to the air in the plenum by reason of the lower wall of the plenum defining structure being provided by the top portions 32*a* and 32*c*. The relatively hot air within the plenum will naturally rise upwardly in the duct 90, but may be drawn upwardly by the domestic hot air heating system, or forced upwardly by the blower 42** discussed previously.

As mentioned previously the side walls and the front and rear walls of the rectangular stove are welded to the bottom wall, or floor of the stove, and the one piece top is also welded to these vertically extending side, front and rear walls. These side, front and rear walls are not welded to one another, as in prior art stove constructions, and it is an important feature of the present invention that these vertically extending side, front and rear walls are formed from a single sheet of steel, and are bent at the four corners of the stove to a generous radius in order to form a stronger stove than has been the case with prior art stoves. This one piece side wall construction permits the door opening to be formed at the opposite ends of said one piece sheet, and the ends of the sheet, above and below the door opening is welded to form the vertically extending portion of the stove structure. The bottom and top of the stove is welded in place as described above to provide a unique structurally integrated stove.

Figure 12:
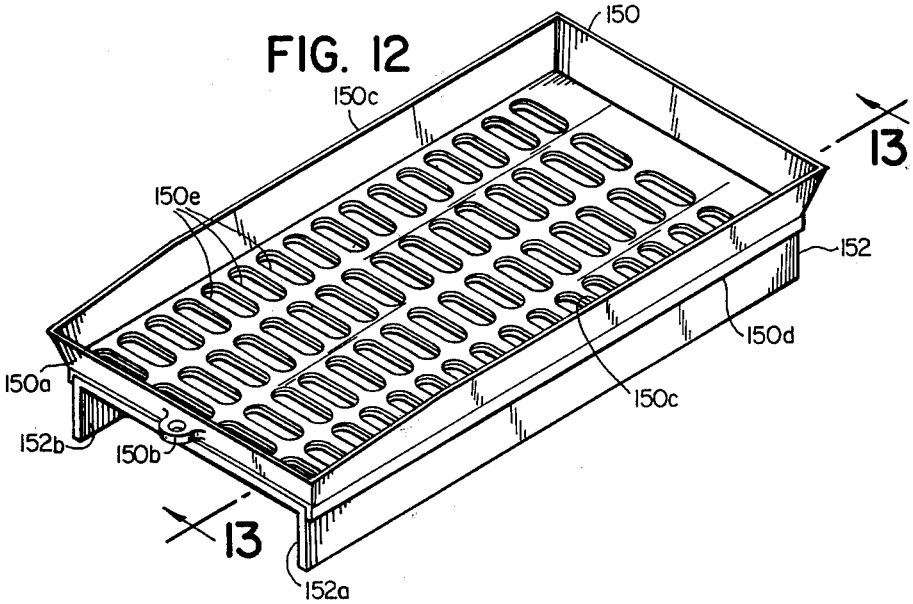
FIG. 12 is a perspective view of a novel coal grate suitable for use inside either the FIG. 1 or the FIG. 9 stove.
Figure 13:
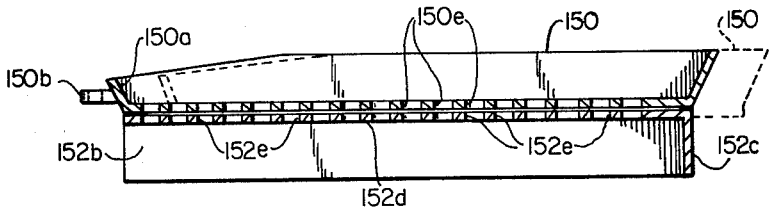
FIG. 13 is a vertical longitudinal sectional view through the coal grate depicted in FIG. 12.

DETAILED DESCRIPTION OF COAL GRATE SHOWN IN FIGS. 12 and 13

Turning next to the coal grate shown in FIGS. 12 and 13, this improved accessory permits the stoves described above to be converted from wood burning to coal burning. The grate itself is made in two parts which can be separately inserted inside the stove, and are so designed that when installed, they do not interfere with the tubular U-shaped conduits described above. It will also be apparent that this improved coal grate structure can also be used in stoves made by other manufacturers, provided only that the stove is of air-tight construction, and sturdy enough to withstand the higher temperatures characteristic of coal burning stoves.

When installed in the generally rectangular stoves shown and described herein, the baffle plate 70 shown and described with reference to FIG. 7 should be removed by means of the threaded fasteners 72, 72. This will permit the larger combustion airflow required to burn coal. FIG. 10 shows a stove of my presently preferred design with this baffle plate 70 removed. Thus, the coal grate construction of FIG. 12 can be installed in this FIG. 10 stove, and the combustion air regulated solely by the rotatable air inlet valves 60, 60.

Referring now to FIG. 12, the novel coal grate shown in this view preferably has a rectangular shape, not only to fit conveniently inside the stoves just described, but also to permit the upper pan 150 to be moved longitudinally relatively to the lower frame 152. The front edge 150*a* has a projecting ear 150*b* with a small hole defined therein so that a poker (not shown) or other implement can be used to periodically shake down the ash residue from the pan onto the floor of the stove firebox.

The fixed frame 152 is of inverted U-shape, having laterally spaced legs 152*a* and 152*b* which rest on the floor of the stove firebox (not shown in FIGS. 12 and 13 but described previously with reference to FIGS. 1–11), these legs are so spaced from one another as to be received between the lower legs 38*a*, 38*a* of the conduits, and to rest upon the firebrick floor 20 of the FIG. 1 or the FIG. 10 stove constructions. This frame preferably has a rear wall 152*c* and a top wall 152*d* which has openings 152*e*, 152*e* as shown.

The upper pan 150 is shaped like a box, and has outwardly inclined side walls 150*c*, 150*c* integrally connected to similarly inclined front and rear walls as shown. The pan 150 and frame 152 are preferably made from cast iron and the pan has depending flanges 150*d*, 150*d* provided thereon to slidably receive the frame 152 therebetween. The bottom wall of the pan 150 is provided with openings 150*e*, 150*e* corresponding in size, shape, and in location to the openings 152*e*, 152*e* provided in the frame so that longitudinal movement of the pan relative to the frame can be used to adjust the net open area of the alignable openings. This adjustment, achieved by means of the hole in ear 150*b*, can be used to control the rate of burning of the coal placed on the pan 150.

As so constructed and arranged, the improved coal grate of FIGS. 12 and 13 can be used to convert the wood burning stoves of FIGS. 1–11 to coal burning, and the only additional step required for this conversion will be to remove the baffle plate 70 from the inside of the stove access door. In order to supplement a domestic hot air heating system, one need only remove the louvered escutheons 34*a* from the outlets 34, and place the plenum 80 on the lower top portion of the stove as shown in FIG. 9, so that a duct 90 can be used to supplement hot air into the domestic home heating system.

I claim:

1. A stove for household heating, comprising:

(a) a stove structure having a floor and side walls including front and rear walls, said rear wall being higher than said front wall, and a top with a front portion at the height of said front wall and a rear portion at the height of said rear wall, and an intermediate top portion which is sloped and which faces generally forwardly, said top portions integrally formed from one piece of sheet steel, (b) an access door for closing an opening in said front wall, (c) air inlet valve means mounted in said door for admitting combustion air to the interior of said stove structure, (d) at least one conduit inside said stove structure including an open end lower portion for receiving room air outside of said stove structure and an upper portion having a forward end communicating with an opening in said sloped top portion, (e) means for introducing room air into the open end of said lower portion so that this air is heated in the stove structure and returned to the room through said opening in said sloped portion of said top, (f) adjustable means in said top opening for controlling the direction of the heated air returned to the room through said top opening, (g) a shroud provided in an opening of said stove rear wall, said shroud having one end portion projecting inside the rear wall of the stove and defining a radially inwardly projecting flange, which flange defines a flue opening, an opposite end of said shroud projecting outside the rear wall of the stove structure, and (h) a flue duct segment mounted in said flue opening and cooperating with said shroud to define a heat exchange cavity for receiving a fluid heat exchange device.

2. The stove according to claim 1 wherein said air inlet valve means comprises at least one threaded member threadably received in a lower region of said door and adapted to meter inlet air through associated openings through said door, and a baffle plate mounted to the inside of said door and having a lower region defining a series of primary air outlets arranged laterally across the width of said door mounted baffle plate, said baffle plate having an integrally defined peripheral flange adjacent the sides and bottom of the door and a baffle wall above said primary air outlets, said wall and peripheral flange abutting said door to define a primary air chamber between the door and said baffle plate and openings in said baffle wall to provide air flow into a secondary air chamber defined between said door and plate above said baffle wall, and secondary air outlets in said baffle plate to provide secondary air to the interior of the stove structure through secondary air outlets above the said primary air flow outlets.

3. The stove according to claim 2 wherein said access door has marginal side edges overlapping said wall opening, said baffle plate fitting within said opening, and a seal provided at the corner defined by said baffle plate and door for engaging the marginal side edges of said opening defining portion of said wall.

4. The stove according to claim 2 wherein two conduits are provided, each conduit having a generally U-shaped configuration provided alongside said stove structure side walls, said means for introducing room air including a crossover pipe communicating with the open ends of the lower leg portions of said U-shaped conduits, one end of said crossover pipe projecting through one of said side walls and adapted to be connected to a source of room air under pressure.

5. The stove according to claim 4 further wherein said means for introducing room air includes a blower for drawing room air from the room and forcing the air into said one end of said crossover pipe.

6. The stove according to claim 4 further characterized by a firebrick liner for said floor, said liner having a thickness somewhat less than the depth of said lower leg portion of said U-shaped conduits, and said lower leg portions and crossover pipe located along the sides and front edge respectively of said floor with said firebrick liner provided therebetween.

7. The stove according to claim 4 wherein said access door has marginal side edges overlapping said wall opening, said baffle plate fitting within said opening, and a seal provided at the corner defined by said baffle plate and door for engaging the marginal side edges of said opening defining portion of said wall.

8. The stove according to claim 7 wherein said air inlet valve means includes two inlet air valve members provided in the lower region of said access door, each of said members being threadably received in associated threaded openings in said door and having associated air openings adapted to be covered by said valve members to meter the flow of air into said primary air chamber.

9. The above according to claim 7 further characterized by shelf means associated with the lower marginal edge of said door opening, said shelf means defining a depression therein to catch ashes or the like.

10. The stove according to claim 1 wherein two conduits are provided, each conduit having a generally U-shaped configuration and provided alongside said stove structure side walls, said means for introducing room air including a crossover pipe communicating with the open ends of the lower leg portions of said U-shaped conduits, one end of said crossover pipe projecting through one of said side walls and adapted to be connected to a source of room air under pressure.

11. The stove according to claim 10 further wherein said means for introducing room air includes a blower for drawing room air from the room and forcing the air into said one end of said crossover pipe.

12. The stove according to claim 10 further characterized by a firebrick liner for said floor, said liner having a thickness somewhat less than the depth of said lower leg portions of said U-shaped conduits, and said lower leg portions and crossover pipe located along the sides and front edge respectively of said floor with said firebrick liner provided therebetween.

13. The stove according to claim 12 further characterized by four legs for supporting the floor of said rectangular stove structure, each of said legs being adjustable in length and recessed inwardly of the four corners of said rectangular stove structure.

14. The stove according to claim 1 further characterized by shelf means associated with the lower marginal edge of said door opening, said shelf means defining a depression therein to catch ashes or the like.

15. The stove according to claim 14 wherein said air inlet valve means includes two inlet air valve members provided in the lower region of said access door, each of said members being threadably received in associated threaded openings in said door and having associated air openings adapted to be covered by said valve members to meter the flow or air into said primary air chamber.

16. The stove according to claim 1 further characterized by an annular fluid storage tank in said heat exchange cavity and fluid inlet and outlet means associated with said tank.

17. The stove according to claim 1 wherein said front, rear and side walls are fabricated from sheet steel bent at spaced locations to form four rounded edges of the rectangular structure.

18. The stove according to claim 17 further characterized by plenum chamber defining means communicating with said opening in said sloped top portion, and means providing communication between said plenum chamber and a heating duct or the like to provide heated air from said conduit into said heating duct.

19. The stove according to claim 18 wherein said plenum chamber defining means comprises a generally rectangular structure with a top, laterally spaced side walls, and a front wall, said intermediate stove top portion and said front stove top portion providing lower and rear boundary surfaces for said plenum chamber, said plenum chamber defining means being readily removable from said stove top as a result of this construction.

20. The stove according to claim 17 wherein said door opening is defined in part adjacent the opposite ends of said sheet steel sides, and said ends butt welded to one another above and below said door opening.

21. The stove according to claim 20 wherein said air inlet valve means comprises at least one threaded member threadably received in a lower region of said door and adapted to meter inlet air through associated openings through said door, and a baffle plate mounted to the inside of said door and having a lower region defining a series of primary air outlets arranged laterally across the width of said door mounted baffle plate, said baffle plate having an intergrally defined peripheral flange adjacent the sides and bottom of the door and a baffle wall above said primary air outlets, said wall and peripheral flange abutting said door to define a primary air chamber between the door and said baffle plate and openings in said baffle wall to provide air flow into a secondary air chamber defined between said door and plate above said baffle wall, and secondary air outlets in said baffle plate to provide secondary air to the interior of the stove structure through secondary air outlets above the said primary air flow outlets.

22. The stove according to claim 21 wherein said access door has marginal side edges overlapping said wall opening, said baffle plate fitting within said opening, and a seal provided at the corner defined by said baffle plate and door for engaging the marginal side edges of said opening defining portion of said wall.

23. The stove according to claim 17 wherein two conduits are provided alongside said stove structure side walls, each conduit being of U-shape having a lower leg portion defining said open ended portion thereof and an upper leg portion defining said air outlet communicating with said top intermediate portion, and means for introducing room air into said open ended lower leg portions of said U-shaped conduits, said last mentioned means including a crossover pipe communicating with said open ended lower leg portions, and at least one end of said crossover pipe projecting through one of said side walls for communicating with a source of air to be heated.

24. The stove according to claim 23 further characterized by a firebrick liner for said floor, said liner having a thickness somewhat less than the depth of said lower leg portions of said U-shaped conduits, and said lower leg portions and crossover pipe located along the sides and front edge respectively of said floor with said firebrick liner provided therebetween.

25. The stove according to claim 24 further characterized by four legs for supporting the floor of said rectangular stove structure, each of said legs being adjustable in length and recessed inwardly of the four corners of said rectangular stove structure.

26. The stove according to claim 1 further characterized by four adjustable legs, each leg having a fixed portion mounted to the underside of said stove floor, each leg including a lower portion adjustably mounted in said fixed portion, and a heat radiating plate supported by said fixed leg portions in spaced relationship below said floor and generally coextensive therewith.

27. The stove according to claim 1 further characterized by reservoir defining humidifier means associated with the rear wall of the stove, said humidifier means including a vertically extending support plate having flange means adjacent its upper end to support said reservoir defining means adjacent its lower end, said flange means cooperating with a lip defined by said top rear portion.

28. The stove according to claim 1 further characterized by a smoke baffle plate associated with said access door opening, and means pivotally mounting said smoke baffle plate to the inside of said stove front wall.

29. The stove according to claim 1 further characterized by a coal grate for the inside of said stove structure, said coal grate having a fixed rectangular frame which is of inverted U-shape with the legs of the U supporting said frame on the inside floor of said stove, and a longitudinally slidable pan on said frame, said pan having openings defined in its bottom wall, and said pan having integral side walls and front and rear walls for receiving the charge of coal to be burned.

* * * * *